US006101688A

United States Patent [19]

Marchesi

[11] Patent Number: 6,101,688

[45] **Date of Patent: *Aug. 15, 2000**

[54] MAGNETIC CLOSURE WITH CASING MADE OF NONFERROMAGNETIC MATERIAL, FOR BAGS, ITEMS OF CLOTHING AND THE LIKE

[75] Inventor: Alberto Marchesi, Milan, Italy

[73] Assignee: SAMA S.p.A., Milan, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,703

[22] Filed: Jul. 9, 1997

[30] Foreign Application Priority Data

Jul. 12, 1996 [IT] Italy ..... MI96A1451

[51] Int. Cl.[7] ..... A44B 21/00

[52] U.S. Cl. ..... 24/303

[58] Field of Search ..... 24/303, 66.1; 292/251.5; 335/284, 302–304

[56] References Cited

U.S. PATENT DOCUMENTS

| | | | |
|---|---|---|---|
| 3,041,743 | 7/1962 | Monsma | 24/303 |
| 4,399,595 | 8/1983 | Yoon et al. | 24/303 |
| 4,779,314 | 10/1988 | Yoshihiro . | |
| 4,799,298 | 1/1989 | Matoba | 24/198 X |
| 5,152,035 | 10/1992 | Morita | 24/303 |
| 5,448,806 | 9/1995 | Riceman et al. | 24/303 |
| 5,450,658 | 9/1995 | Hicks | 24/303 |
| 5,473,799 | 12/1995 | Aoki | 24/303 |
| 5,675,874 | 10/1997 | Chen | 24/303 |

FOREIGN PATENT DOCUMENTS

| | | |
|---|---|---|
| 0 490 663 | 6/1992 | European Pat. Off. . |
| 35 44 626 | 11/1986 | Germany . |
| 94 06319 | 3/1994 | WIPO . |

*Primary Examiner*—James R. Brittain
*Attorney, Agent, or Firm*—Guido Modiano; Albert Josif

[57] ABSTRACT

A magnetic closure with a casing made of nonferromagnetic material, for bags, items of clothing and the like, comprising a container which can be coupled to one of two mutually opposite flaps to be joined and forms a seat for at least one ring made of magnetic material. The container is thinner at a coupling surface of the ring. There are also provided elements to increase the tearing resistance of the magnetic ring in the container.

8 Claims, 1 Drawing Sheet

MAGNETIC CLOSURE WITH CASING MADE OF NONFERROMAGNETIC MATERIAL, FOR BAGS, ITEMS OF CLOTHING AND THE LIKE

BACKGROUND OF THE INVENTION

The present invention relates to a magnetic closure with a casing made of nonferromagnetic material, for bags, items of clothing, and the like.

Currently commercially available so-called magnetic closures or clasps are usually provided by means of a female element, constituted by a ring obtained from a permanent magnet, which is covered by a covering element generally made of brass or the like; the covering element axially forms a cavity in which a cylindrical protrusion or male element enters which is made of a ferromagnetic material and can be coupled to the other one of the flaps to be joined.

This embodiment is, in a way, necessary because insertion of the male element in the female part provides for centering, but in many cases there is some difficulty in achieving guiding for coupling, since the ferromagnetic male element does not tend to enter the axial cavity if the two elements are not perfectly centered at the time of coupling.

These magnetic closures are not suitable for application to items of clothing, since the use of ferromagnetic material, which can rust, is obviously not compatible with the washes to which an item of clothing can be subjected; accordingly, it would be necessary to provide a hermetic magnetic closure, but the provision of a container made of plastics or other materials, by entailing considerable thicknesses, produces significant difficulties in coupling, since the magnetic coupling force is very weak or, if low thicknesses are used, it is very easy to produce a tear in the thinner covering element.

SUMMARY OF THE INVENTION

The aim of the present invention is to solve the above problems by providing a magnetic closure with a casing made of nonferromagnetic material, for bags, items of clothing and the like, which can be externally provided, at the coupling region, with a casing made of plastics, rubber or other materials, without an appreciable reduction in the magnetic adhesion force and without risking damage to the outer surface.

Within the scope of the above aim, a particular object of the present invention is to provide a magnetic closure which has self-centering and correct positioning guiding characteristics and can automatically achieve the correct coupling of the elements arranged on the two flaps to be joined.

Another object of the present invention is to provide a magnetic closure which can be easily applied with conventional methods to bags, items of clothing and the like and is furthermore capable of giving the greatest assurances of reliability and safety in use.

Another object of the present invention is to provide a magnetic closure with a casing made of nonferromagnetic material, for bags, items of clothing and the like which can be easily obtained starting from commonly commercially available elements and materials and is furthermore competitive from a merely economical point of view.

This aim, these objects and others which will become apparent hereinafter are achieved by a magnetic closure with a casing made of nonferromagnetic material, for bags, items of clothing and the like, characterized in that it comprises a container which can be coupled to one of two mutually opposite flaps to be joined and forms a seat for at least one ring made of magnetic material, said container being thinner at a coupling surface of said ring, means being furthermore provided to increase the tearing resistance of said ring in said container.

BRIEF DESCRIPTION OF THE DRAWINGS

Further characteristics and advantages of the present invention will become apparent from the following detailed description of a preferred but not exclusive embodiment of a magnetic closure with a casing made of nonferromagnetic material, for bags, items of clothing and the like, illustrated only by way of non-limitative example in the accompanying drawings, wherein.

DESCRIPTION OF THE PREFERRED EMBODIMENTS

Figure 1:
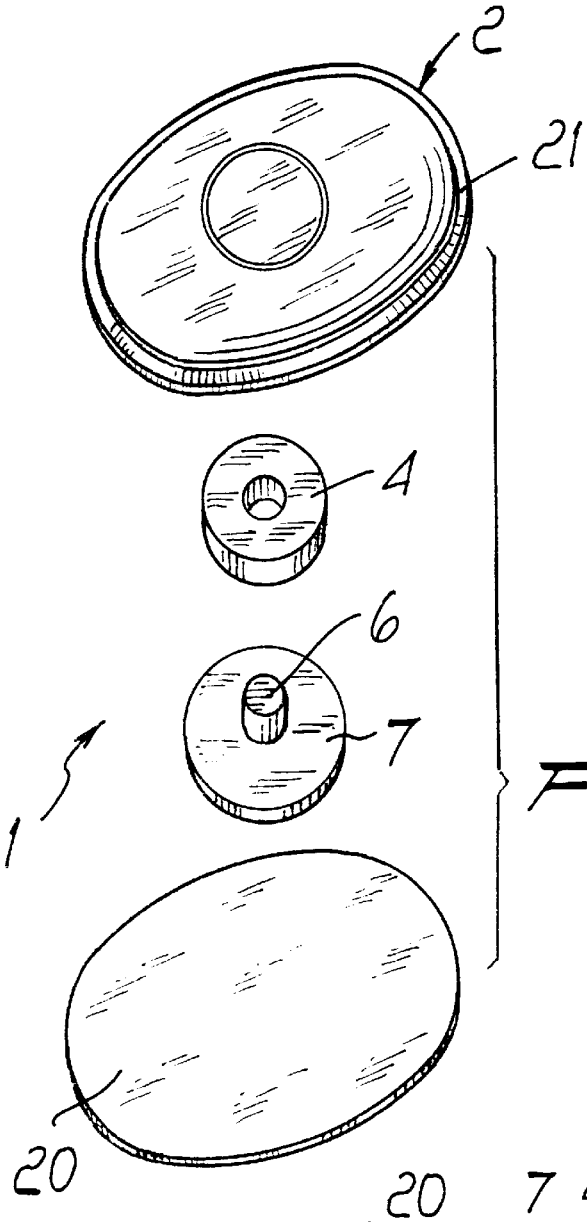
FIG. 1 is a schematic exploded view of the magnetic closure according to the present invention.
Figure 2:
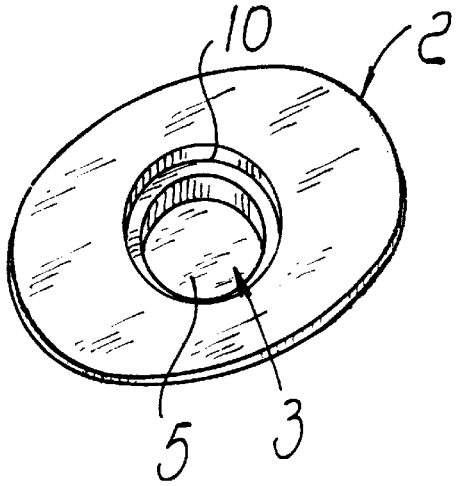
FIG. 2 is a perspective view of the container, seen from its inner face.

With reference to the above figures, the magnetic closure with a casing made of nonferromagnetic material, for bags, items of clothing and the like, according to the invention, is generally designated by the reference numeral 1 and comprises a container 2 which is made of nonferromagnetic material, preferably of rubber, plastics or other materials.

The container 2, which can have any shape deemed appropriate, forms a seat 3 for a ring 4 made of magnetic material, which is arranged so as to lie at a thinner casing portion 5, at the region where coupling to the other flap occurs.

In order to increase the magnetic force that can be applied, inside the ring 4 there is provided a core 6 made of ferromagnetic material, which is connected to a flange 7 made of ferromagnetic material which can be provided as a separate element with respect to the core or can be obtained monolithically with the core.

The flange 7 protrudes with respect to the ring 4 in order to form means capable of increasing the tearing resistance of the ring 4 in the container 2.

As mentioned earlier, the casing portion has a very reduced thickness, so that tearing forces might be produced which could damage the thinner casing; on the other hand, it is necessary to maintain a reduced thickness to avoid decreasing the magnetic adhesion force.

In order to provide the means for increasing tearing resistance, the flange 7 engages a recess 10 of the seat 3 which is formed in a region of the container 2 which is thicker and thus mechanically effective for withstanding the tearing force.

Another important factor to be noted is constituted by the fact that the closure is obtained by applying to one of the flaps a container in which the magnet has an axial orientation polarity in one direction and by applying to the other flap to be joined a container 2 which has a magnet whose axial orientation polarity lies in the opposite direction.

Figure 3:
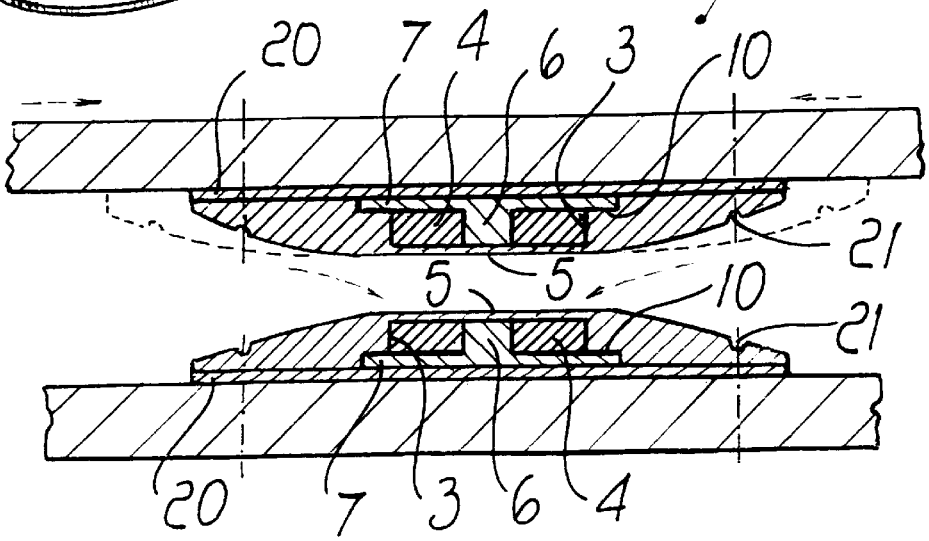
FIG. 3 is a schematic sectional view of the coupling of the magnetic closure.

In this manner, magnetic forces are produced which in addition to providing stable adhesion are also capable of self-centering the two elements, as shown schematically by the dashed lines of FIG. 3, and also constitute a guide for correct positioning.

By moving the elements placed on the two opposite flaps towards each other, a translatory component is in fact automatically generated which produces the correct axial positioning of the two closure elements arranged on the opposite flaps.

It should be added to the above that the container 2 is closed to the rear by a plate 20 which can be applied by gluing or by welding and can be hermetic and in any case has the purpose of sealing from the outside the region where the ferromagnetic materials are placed, in order to prevent the outward spread of rust during washes.

The container 2 is peripherally provided with a recessed rim, designated by the reference numeral 21, which can indicate the region for sewing onto the item of clothing, without altering the concept that the magnetic clasp can be applied to the corresponding flap also by glueing, thermal bonding or other methods.

From the above description it is thus evident that the invention achieves the intended aim and objects, and in particular the fact is stressed that the provision of a magnetic closure in which two elements having a mutually oppositely arranged ring magnet allows to achieve a high magnetic clamping action together with the possibility to achieve automatic centering without having to resort to mechanical coupling elements, as can instead be observed in the prior art.

It should be added to the above that a plurality of side-by-side magnets can also be arranged in the same container if necessary, without altering the concept that the magnets must have mutually opposite polarities on the opposite flap.

The invention thus conceived is susceptible of numerous modifications and variations, all of which are within the scope of the inventive concept.

All the details may furthermore be replaced with other technically equivalent elements.

In practice, the materials employed, so long as they are compatible with the specific use, as well as the contingent shapes and the dimensions, may be any according to requirements.

What is claimed is:

1. A magnetic closure with a casing made of nonferromagnetic material, for bags, items of clothing and the like, comprising at least one container which is made of a soft material and can be coupled to one of two mutually opposite flaps to be joined and forms a seat for at least one ring made of magnetic material, said container being thinner at a central coupling surface of said ring and being larger than the diameter of the ring, a core made of ferromagnetic material connected to a flange is arranged inside the ring of magnetic material and abuts against the thinner central coupling surface of said container, said flange protruding with respect to the ring, abutting against a portion of the container which is thicker than the central coupling surface thereof, to increase the tearing resistance of said ring accommodated in said container and of said container.

2. A magnetic closure according to claim 1, further comprising, on said two mutually opposite flaps to be joined, respective containers made of soft material, which have respective rings made of magnetic material with a magnetic polarity which is directed axially and is mutually opposite.

3. A magnetic closure according to claim 2, wherein said rings made of ferromagnetic material with mutually opposite polarities on said two mutually opposite flaps provide the self-centering and guiding for the coupling of said magnetic closure.

4. A magnetic closure according to claim 1, wherein said flange is made of ferromagnetic material and can be coupled to a face of said ring which lies opposite to a face arranged at said thinner coupling surface.

5. A magnetic closure according to claim 1, wherein said flange which protrudes with respect to said ring made of magnetic material can be accommodated at a recess formed peripherally with respect to said seat in a thicker region of said container.

6. A magnetic closure according to claim 1, further comprising a plate for hermetically closing said container.

7. A magnetic closure according to claim 1, wherein a recess delimiting a region for applying stitches is peripherally provided on said container.

8. A magnetic closure according to claim 1, wherein said container is made of plastics.

* * * * *